US007441523B2

(12) United States Patent
Kido et al.

(10) Patent No.: US 7,441,523 B2
(45) Date of Patent: Oct. 28, 2008

(54) VARIABLE VALVE DEVICE FOR INTERNAL COMBUSTION ENGINE

(75) Inventors: Yusuke Kido, Okazaki (JP); Shinichi Murata, Okazaki (JP); Masaru Mori, Nagoya (JP); Kenta Kotsuji, Uji (JP)

(73) Assignee: Mitsubishi Jidosha Kogyo Kabushiki Kaisha, Tokyo (JP)

( * ) Notice: Subject to any disclaimer, the term of this patent is extended or adjusted under 35 U.S.C. 154(b) by 4 days.

(21) Appl. No.: 11/727,578

(22) Filed: Mar. 27, 2007

(65) Prior Publication Data

US 2007/0227480 A1 Oct. 4, 2007

(30) Foreign Application Priority Data

Mar. 28, 2006 (JP) ..... 2006-088977
Mar. 28, 2006 (JP) ..... 2006-088978

(51) Int. Cl.
*F01L 1/18* (2006.01)

(52) U.S. Cl. ..... 123/90.16; 123/90.44

(58) Field of Classification Search ..... 123/196 M, 123/90.12, 90.33, 90.34, 90.39, 90.44, 90.15, 123/90.16, 90.17
See application file for complete search history.

(56) References Cited

U.S. PATENT DOCUMENTS 4,534,323 A * 8/1985 Kato et al. ..... 123/90.16
5,341,777 A * 8/1994 Miura et al. ..... 123/90.17
5,452,694 A * 9/1995 Hara ..... 123/90.16
5,529,032 A * 6/1996 Oikawa et al. ..... 123/90.16
5,794,576 A * 8/1998 Hara et al. ..... 123/90.16
6,276,320 B1 * 8/2001 Fujii et al. ..... 123/90.16
6,325,028 B1 * 12/2001 Albanello et al. ..... 123/90.12
6,340,010 B1 * 1/2002 Hara et al. ..... 123/90.16
6,763,793 B2 * 7/2004 Murata et al. ..... 123/90.39
6,832,584 B2 * 12/2004 Murata et al. ..... 123/90.16
6,918,363 B2 * 7/2005 Daigo et al. ..... 123/90.16
6,948,465 B2 * 9/2005 Daigo et al. ..... 123/90.16
6,959,675 B2 * 11/2005 Nagano et al. ..... 123/90.16
7,007,646 B2 * 3/2006 Takayasu et al. ..... 123/90.16
7,008,198 B2 * 3/2006 Lee et al. ..... 417/470
7,107,953 B2 * 9/2006 Takayasu et al. ..... 123/90.39
7,124,723 B2 * 10/2006 Yokoyama et al. ..... 123/90.39
2004/0154569 A1 * 8/2004 Nagano et al. ..... 123/90.41
2007/0227481 A1 * 10/2007 Kido et al. ..... 123/90.16

FOREIGN PATENT DOCUMENTS

JP 2005-90408 A 4/2005
JP 2007-262981 * 10/2007

* cited by examiner

*Primary Examiner*—Hai H Huynh
(74) *Attorney, Agent, or Firm*—Birch, Stewart, Kolasch & Birch, LLP

(57) ABSTRACT

A variable valve device for an internal combustion engine includes an internal combustion engine body having a plurality of cylinders, a variable valve mechanism which is provided in the body and is switchable between at least two modes with oil pressure, a mode switching oil control valve which switches the variable valve mechanism to each mode, and a camshaft-driven mode switching oil pump which supplies an oil pressure for switching driving to the variable valve mechanism according to the switching of the mode switching oil control valve. The mode switching oil control valve is, along with the mode switching oil pump, provided in an outer wall surface of the body.

9 Claims, 11 Drawing Sheets

VARIABLE VALVE DEVICE FOR INTERNAL COMBUSTION ENGINE

CROSS-REFERENCE TO RELATED APPLICATIONS

This application is based upon and claims the benefit of priority from prior Japanese Patent Applications No. 2006-088977, filed Mar. 28, 2006; and No. 2006-088978, filed Mar. 28, 2006, the entire contents of both of which are incorporated herein by reference.

BACKGROUND OF THE INVENTION

1. Field of the Invention

The present invention relates to a variable valve device for an internal combustion engine, which is switchable between at least two modes by control of a variable valve mechanism with an oil control valve.

2. Description of the Related Art

Examples of an automobile-mounted reciprocating engine (internal combustion engine) having plural cylinders include an engine which uses a variable valve device to switch to a running mode in which cylinders are partially suspended, i.e., a cylinder suspension mode in order to balance improvement of output characteristics and improvement of fuel consumption, when the engine becomes a stable running condition in which large output is not required for the engine. For example, Jpn. Pat. Appln. KOKAI Publication No. 2005-90408 discloses this kind of engine.

Usually, a structure in which a hydraulic type variable valve mechanism and an oil control valve for cylinder suspension mode are provided in an engine cylinder head is used for the switching. In the structure, a hydraulic variable valve mechanism is switchable to a cylinder suspension mode in which the cylinders are partially suspended, and the oil control valve for cylinder suspension mode switches the variable valve mechanism to the cylinder suspension mode.

When the engine enters a predetennined cylinder suspension running range, the oil control valve for cylinder suspension mode is operated. Engine oil is supplied to the variable valve mechanism through a control valve from a lubricating oil pump mounted on an engine body. Then, the variable valve mechanism is driven by an oil pressure of the engine oil, and lifts (open and close) of an inlet valve and an exhaust valve of the cylinder is suspended (cylinder suspension mode).

Because a lubricating oil pump mounted on an engine body is usually driven by a crankshaft, an oil pressure of engine oil discharged from the lubricating oil pump depends on engine revolution speed. The oil pressure generated by the lubricating oil pump becomes low when the engine revolution speed is decreased, and the oil pressure becomes high when the engine revolution speed is increased.

When the engine switches to the cylinder suspension mode, components of the variable valve mechanism are driven against a force applied from the outside, and thus, an oil pressure necessary for the driving is required.

Therefore, in the lubricating oil pump, the oil pressure necessary for the switching of the variable valve mechanism is not sufficiently secured in the low engine revolution speed range. For this reason, the running in the cylinder suspension mode is hardly performed in the low engine revolution speed range, and consequently, a cylinder suspension running range in which the running is performed in the cylinder suspension mode is significantly restricted.

Some of engines include in a cylinder head, a variable valve mechanism, an oil control valve for cylinder suspension mode, and a camshaft-driven oil pump which is an oil pump dedicated to the switching to the cylinder suspension mode independently of the lubricating oil pump. As a result, an oil pressure necessary for the switching of the variable valve mechanism is secured even in the low engine revolution speed range.

In a variable valve device with the oil pump dedicated to the switching to the cylinder suspension mode, a frequency of the switching to the cylinder suspension mode is increased compared with the use of the lubricating oil pump which is already installed in the engine. Particularly, when the dedicated oil pump is used, an opportunity to perform the running in the cylinder suspension mode is increased because the cylinder suspension mode running in the low engine revolution speed range can be performed as well as idling in the cylinder suspension mode.

Consequently, the use of the oil pump for cylinder suspension mode increases the necessity to perform the maintenance to the oil control valve for cylinder suspension mode with the oil pump for cylinder suspension mode, while the oil control valve for cylinder suspension mode conventionally has the low maintenance frequency. Therefore, importance of the maintenance is increasing in the oil control valve for cylinder suspension mode.

However, in the structure in which the oil control valve for cylinder suspension mode and the oil pump for cylinder suspension mode are accommodated in the cylinder head, the maintenance cannot be performed in the oil control valve for cylinder suspension mode unless a rocker cover which covers an upper portion of the cylinder head is detached. This causes a trouble with the maintenance work of the oil control valve for cylinder suspension, in which the maintenance frequency is increased.

BRIEF SUMMARY OF THE INVENTION

In view of the foregoing, an object of the invention is to provide a variable valve device for an internal combustion engine, in which facilitation of the maintenance is achieved in an oil control valve for cylinder suspending mode and an oil pump for cylinder suspending mode.

According to an aspect of the present invention, there is provided a variable valve device for an internal combustion engine comprise: an internal combustion engine body having a plurality of cylinders; a variable valve mechanism which is provided in the body and is switchable between at least two modes with oil pressure; a mode switching oil control valve which switches the variable valve mechanism to each mode; and a camshaft-driven mode switching oil pump which supplies an oil pressure for switching driving to the variable valve mechanism according to the switching of the mode switching oil control valve. The mode switching oil pump is, along with the mode switching oil control valve, provided in an outer wall surface of the body.

According to the configuration of the invention, the maintenance can be performed in both the mode switching oil control valve and the mode switching oil pump without detaching the parts of the engine body.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Figure 1:
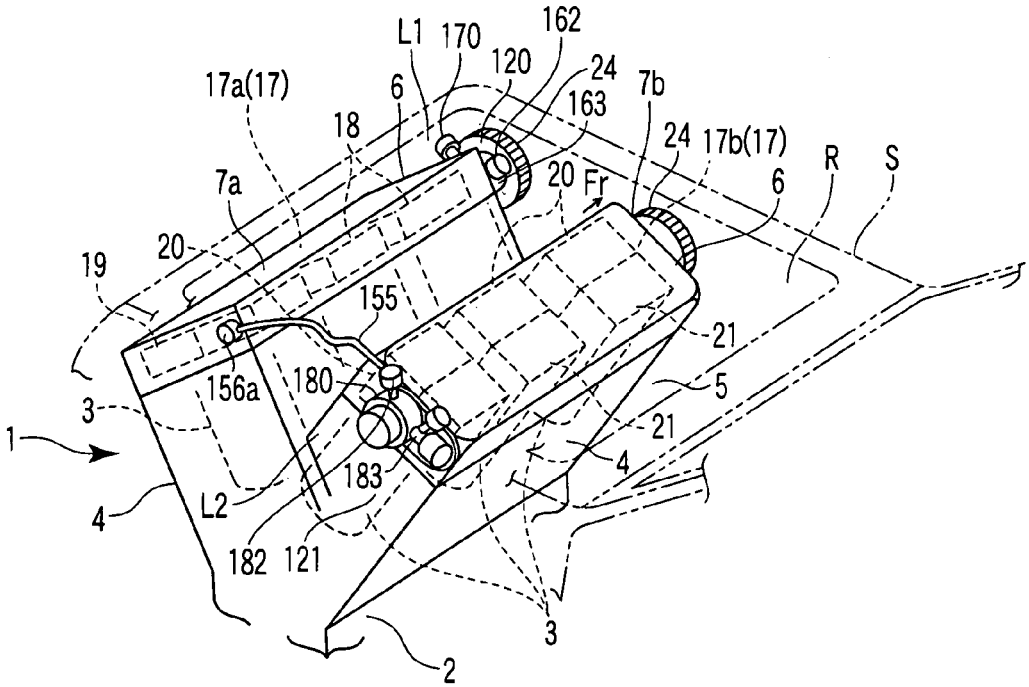
FIG. 1 is a perspective view showing a variable valve device according to an embodiment of the invention, along with a state in which a V-type engine equipped with the variable valve device is mounted on an automobile body.
Figure 2:
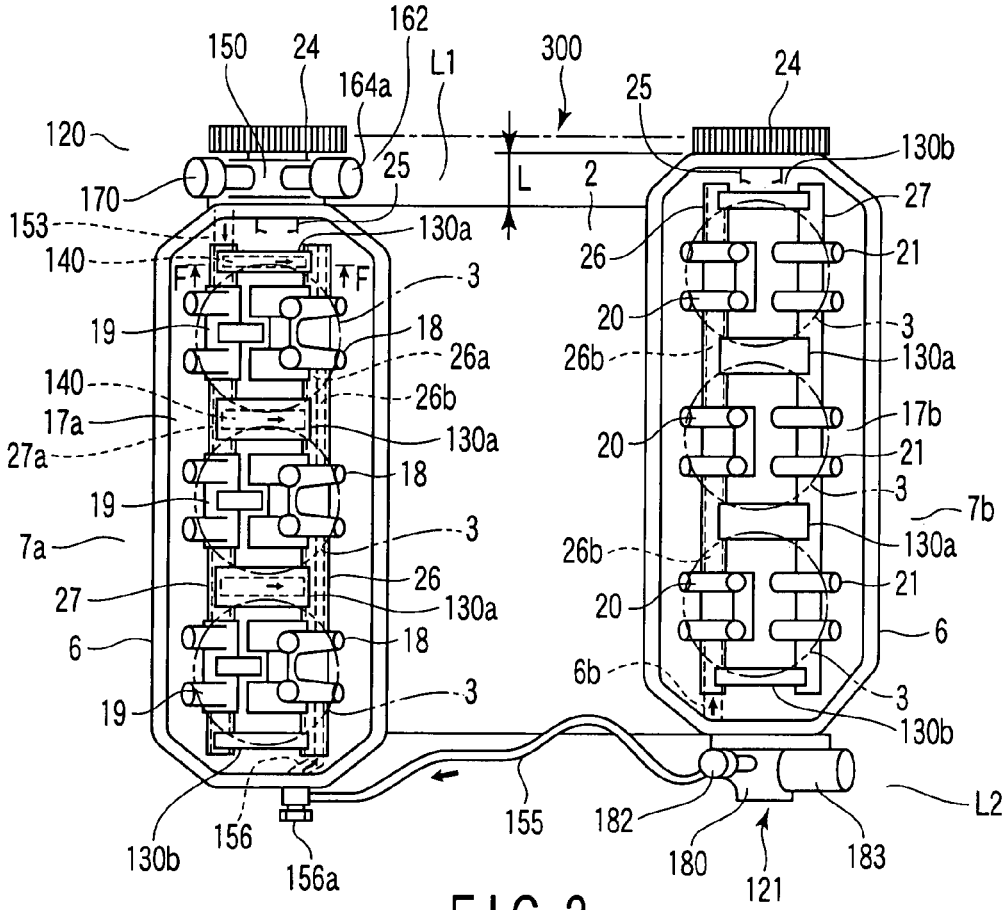
FIG. 2 is a plan view showing variable valve systems of left and right banks of the engine.
Figure 3:
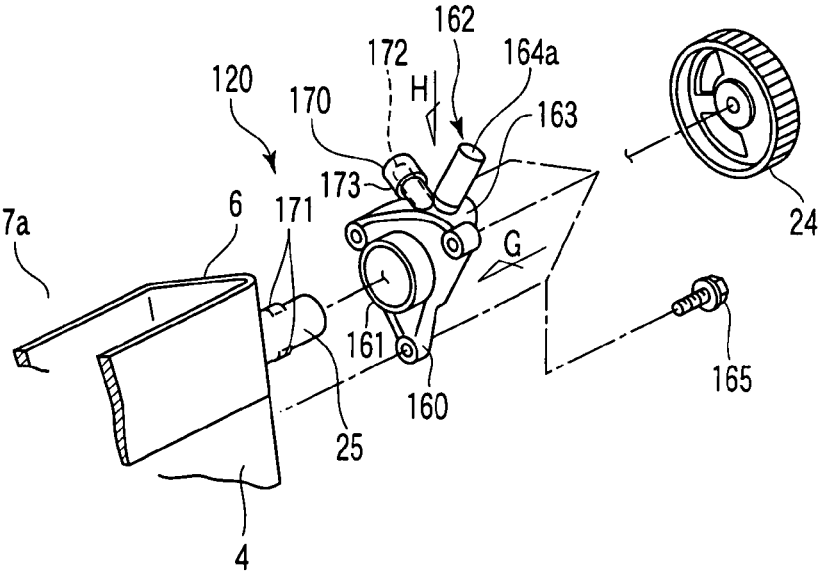
FIG. 3 is an exploded perspective view showing an oil control valve for cylinder suspension mode, which is provided in the left bank (cylinder suspension bank) of the engine.

A variable valve device according to one embodiment of the invention will be described with reference to FIGS. 1 to 19. FIG. 1 is a perspective view showing a state in which an engine (internal combustion engine) where cylinder banks are separated, e.g., a V-type 6-cylinder reciprocating engine (hereinafter simply referred to as V-type engine) is mounted in an automobile body when the engine is viewed from behind. FIG. 2 is a plan view showing each bank of the engine, and FIG. 3 is a perspective view showing an oil control valve for cylinder suspension mode.

Figure 4:
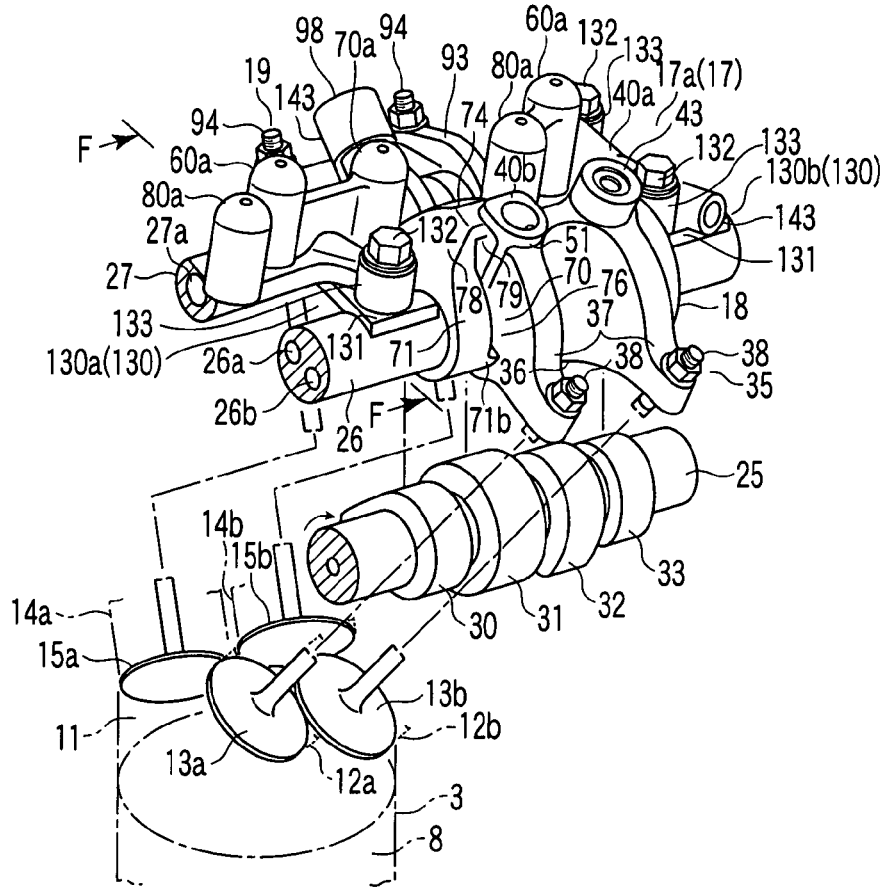
FIG. 4 is a perspective view showing a variable valve device for one cylinder which is mounted on the left bank of the engine.
Figure 5:
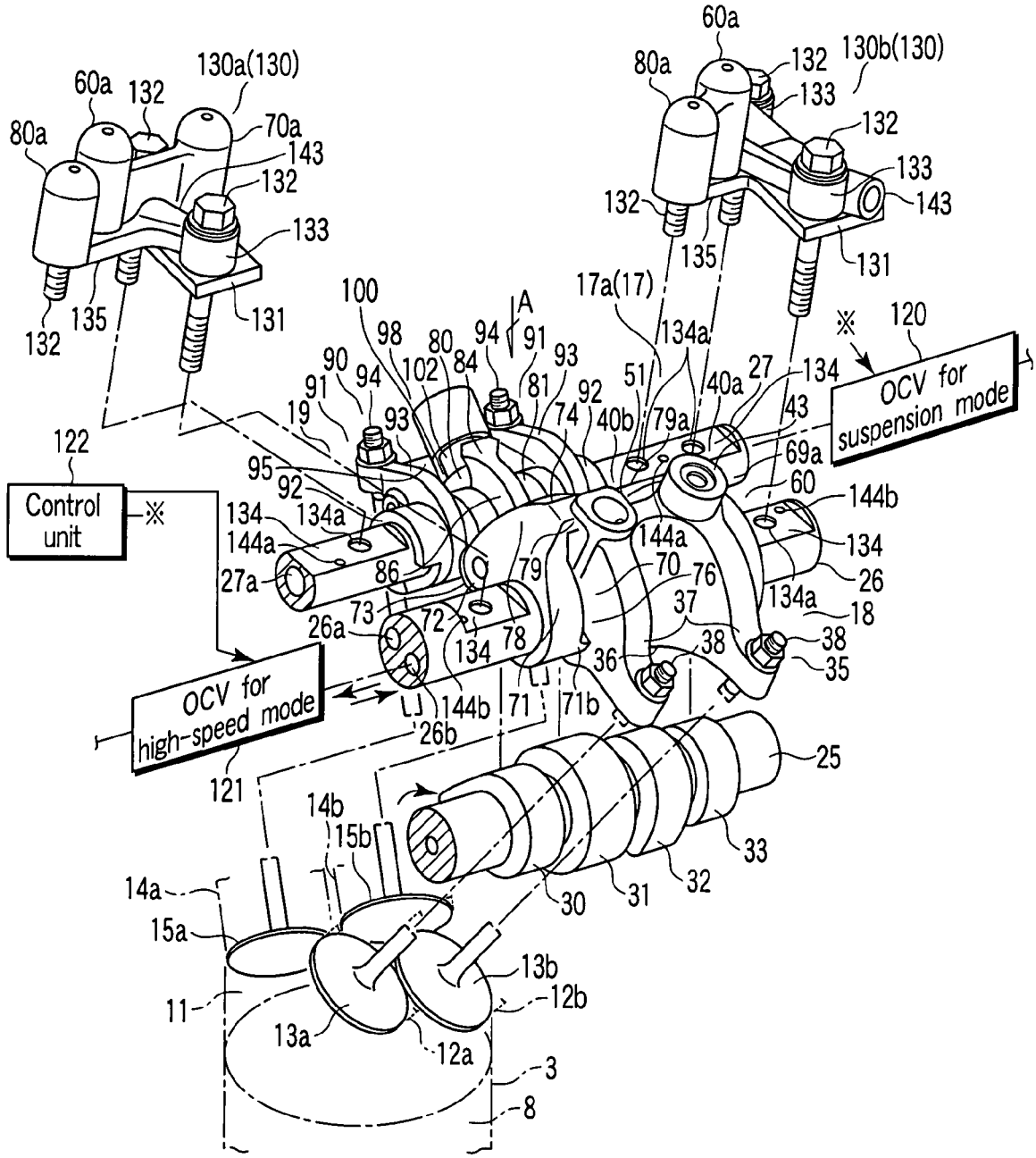
FIG. 5 is a perspective view showing a state in which a rocker shaft cap is disconnected from the variable valve device.
Figure 6:
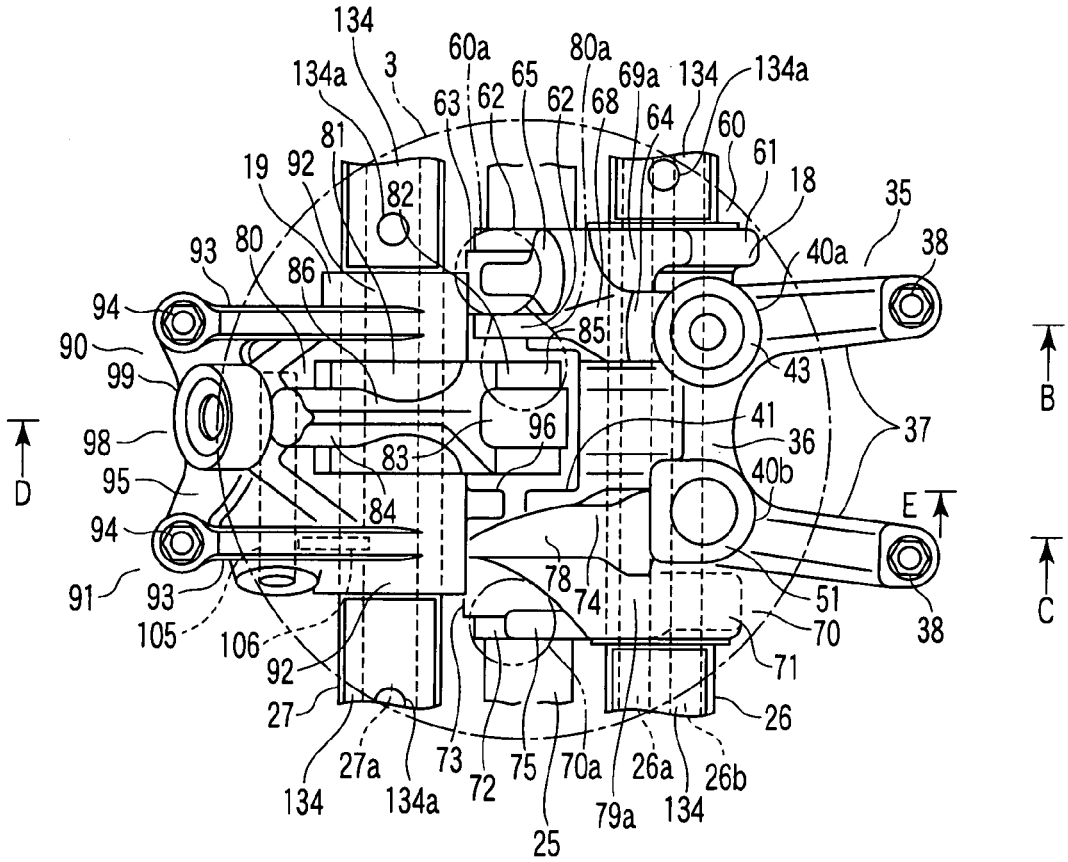
FIG. 6 is a plan view showing the variable valve device when viewed from an arrow A of FIG. 5.
Figure 7:
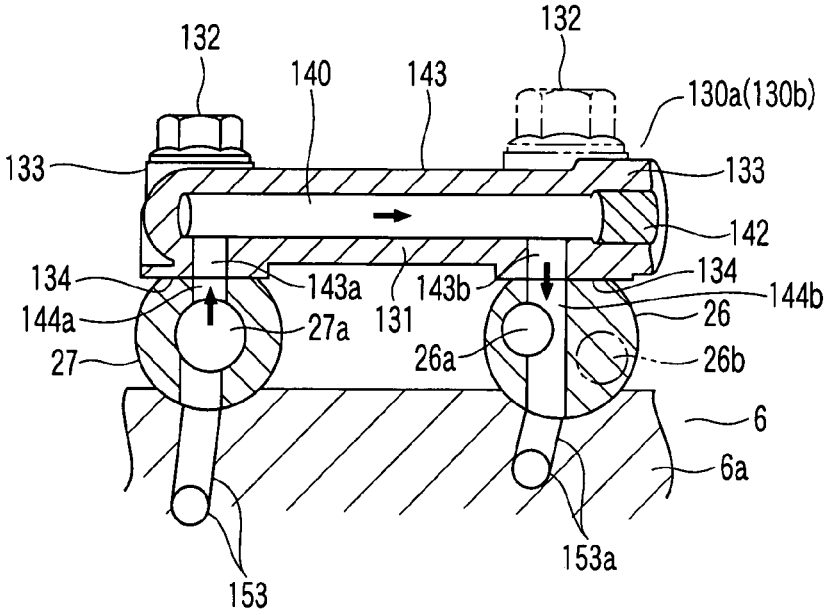
FIG. 7 is a sectional view showing the rocker shaft cap taken along line F-F of FIG. 2.
Figure 8:
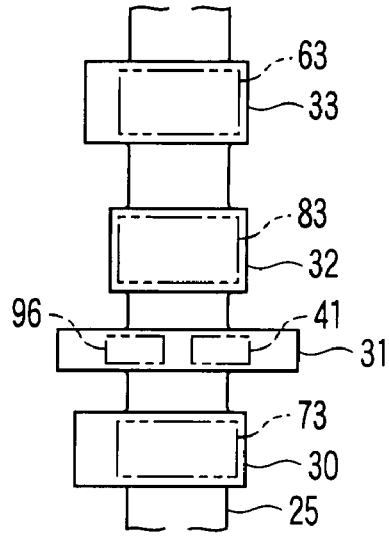
FIG. 8 is a plan view showing a layout of various cams of a camshaft.
Figure 9:
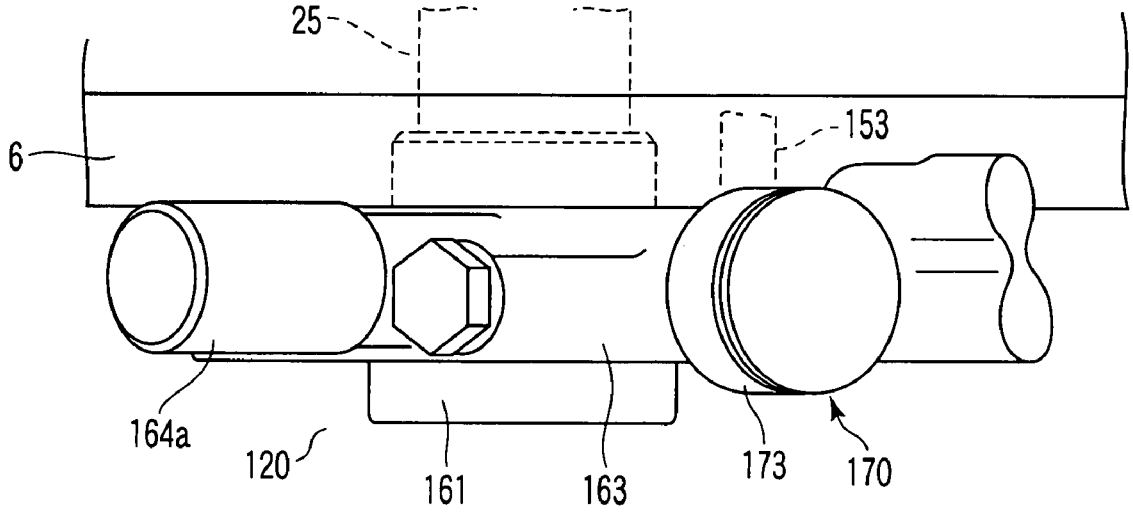
FIG. 9 is a plan view showing an oil control valve for cylinder suspension mode with an oil pump when viewed from an arrow H of FIG. 3.
Figure 10:
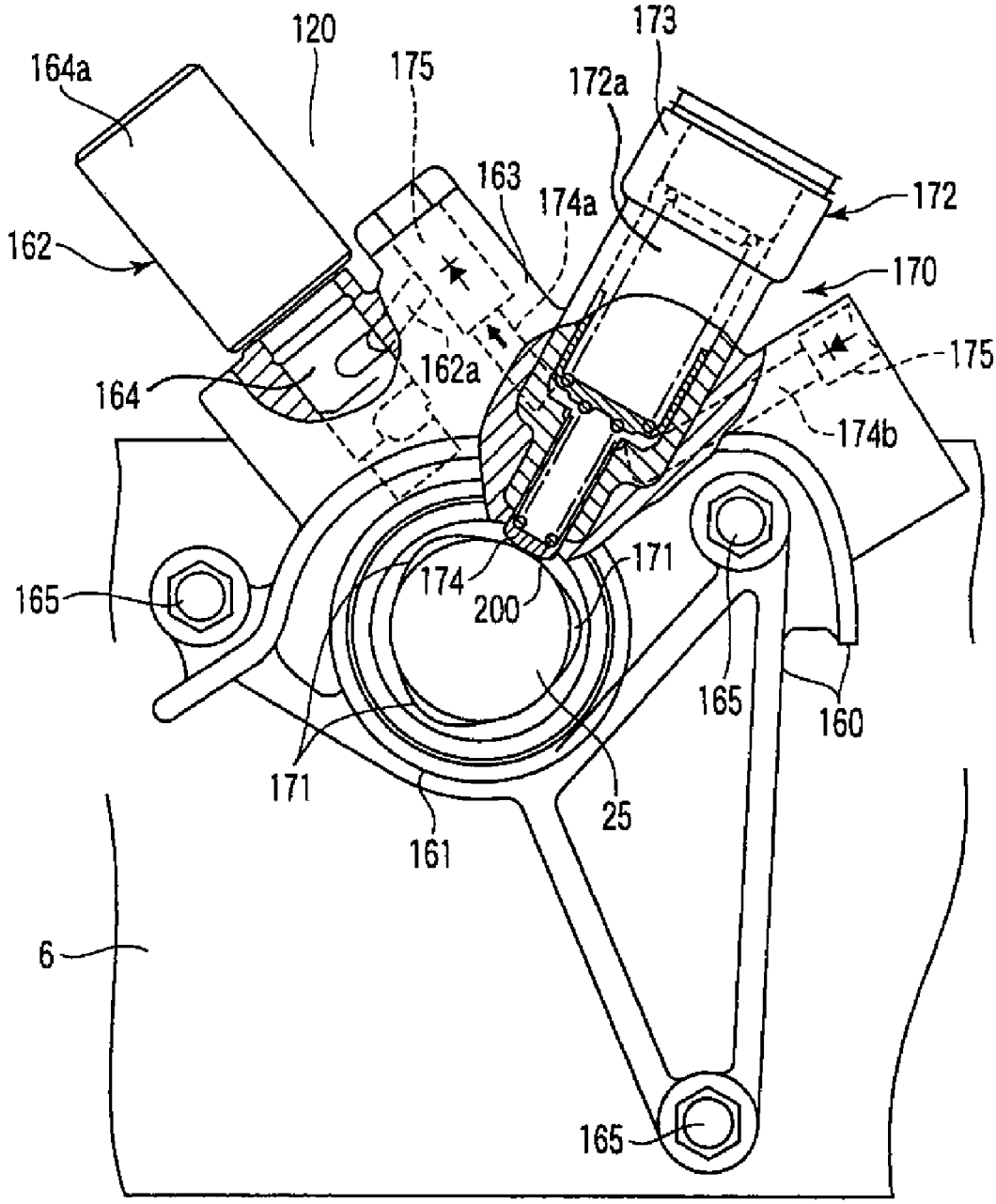
FIG. 10 is a plan view showing the oil control valve when viewed from an arrow G of FIG. 3.

FIG. 4 is a perspective view showing inlet and exhaust variable valve devices for one cylinder of the engine. FIG. 5 is a perspective view showing a state in which a rocker shaft cap is disconnected from the variable valve device. FIG. 6 is a plan view showing the variable valve device when viewed from an arrow A of FIG. 5. FIG. 7 is a sectional view showing the rocker shaft cap taken along line F-F of FIG. 4. FIG. 8 is a plan view showing a layout of various cams in the variable valve device. FIGS. 9 and 10 show an oil control valve for cylinder suspension mode when viewed from arrows H and G of FIG. 3, respectively. FIGS. 11 to 14 are sectional views each showing components of the variable valve device taken along the arrow B to E shown in FIG. 6.

Figure 15:
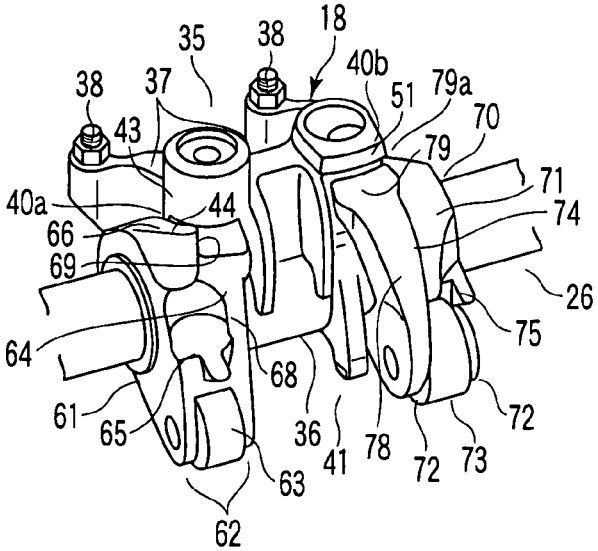
FIG. 15 is a perspective view showing an inlet-side arm rocker structure.
Figure 16:
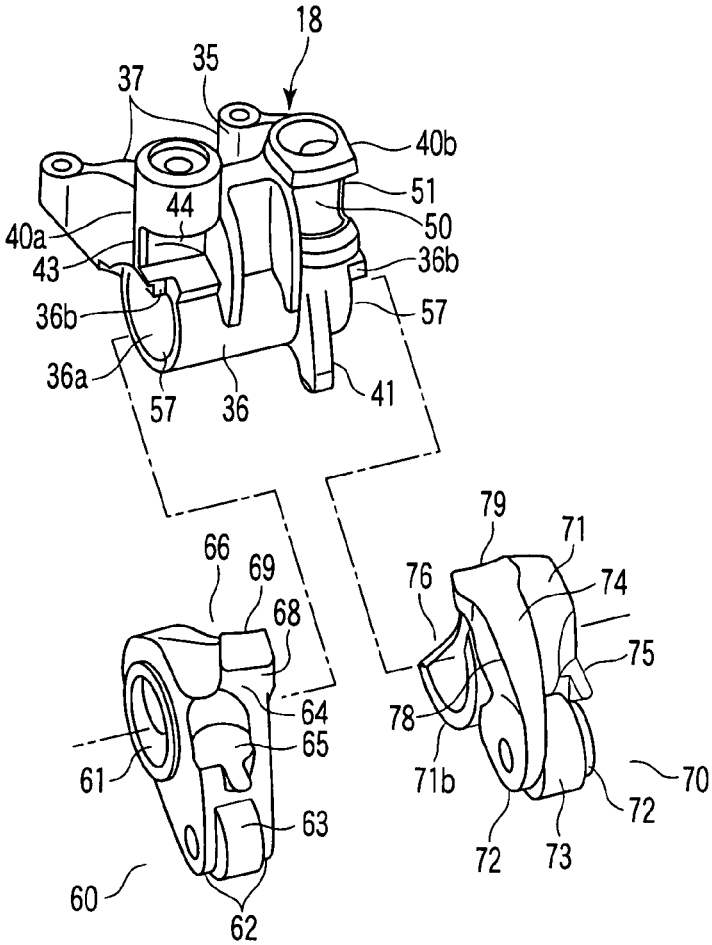
FIG. 16 is a perspective view showing a state in which the inlet-side arm rocker structure is exploded.
Figure 17:
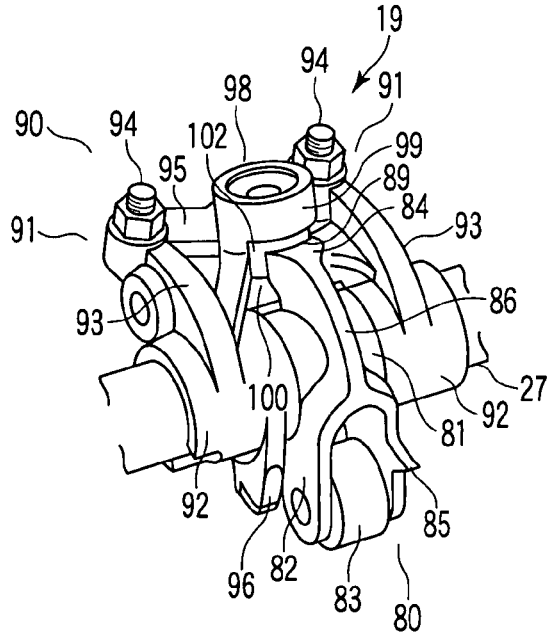
FIG. 17 is a perspective view showing an exhaust-side arm rocker structure.
Figure 18:
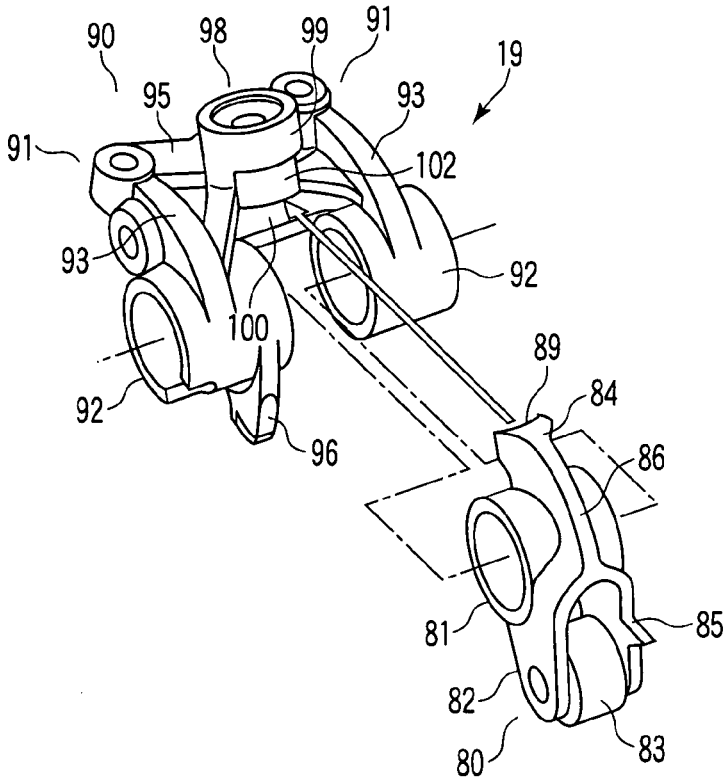
FIG. 18 is a perspective view showing a state in which the exhaust-side arm rocker structure is exploded.
Figure 19:
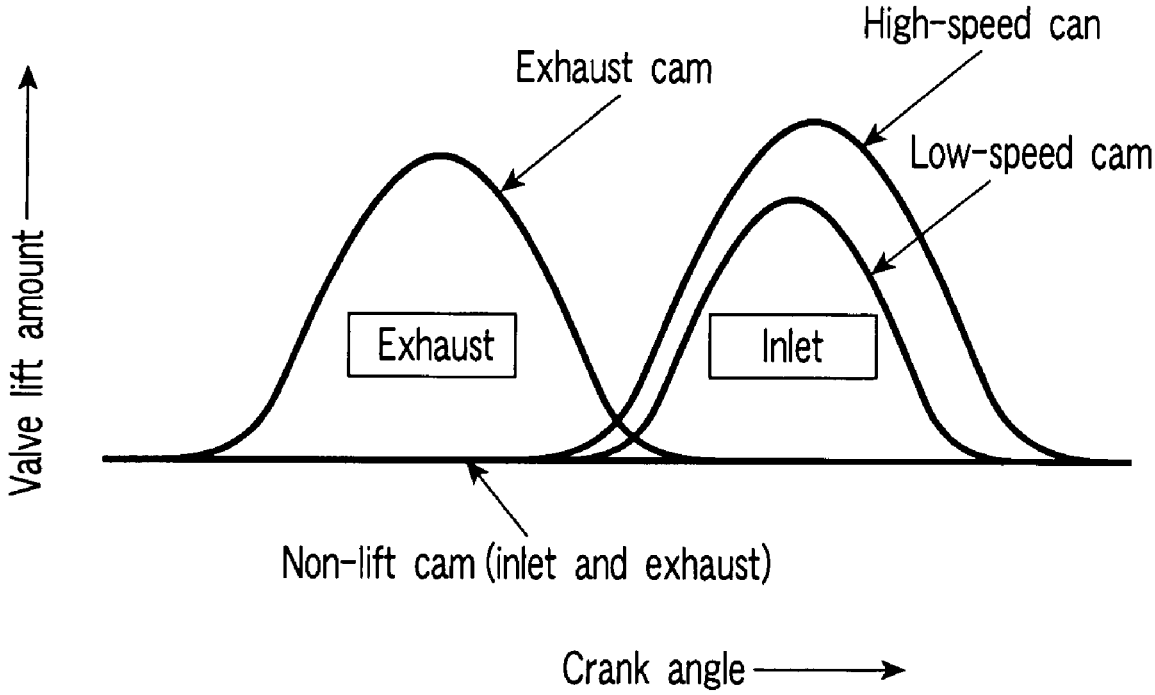
FIG. 19 is a diagram for explaining an operating mode of the variable valve device.

FIG. 15 is a perspective view showing an inlet-side arm rocker structure. FIG. 16 is an exploded perspective view showing the inlet-side arm rocker structure. FIG. 17 is a perspective view showing an exhaust-side arm rocker structure. FIG. 18 is an exploded perspective view showing the exhaust-side arm rocker structure. FIG. 19 is a diagram for explaining valve characteristics brought by the variable valve device.

Referring to FIG. 1, the letter S designates an automobile (vehicle) body, the letter R designates an engine compartment formed in a front portion of the automobile body S, and reference numeral 1 designates an engine body of the reciprocating V-type engine with the variable valve device. The V-type engine is transversely installed in the engine compartment R (shown by an alternate long and two short dashes line).

The engine body 1 includes a V-shape cylinder block 5 and cylinder heads 6. Specifically, the cylinder block 5 includes a common crankcase portion 2 in a lower portion thereof, and V-shape deck cylinder portions 4 in an upper portion thereof. Each of the V-shape deck cylinder portions 4 has three cylinders 3. The cylinder heads 6 are mounted on head portions of the deck cylinder portions 4 respectively.

Small parts such as a head cover and an oil pan are not shown in FIG. 1. Each of left and right banks 7*a* and 7*b* (the left and right of the banks are defined based on the forward direction Fr) projected in a V-shape is formed by the deck cylinder portion 4 and the cylinder head 6, etc.

As shown in FIGS. 4 and 5, a piston 8 is accommodated in the cylinder 3 in each of the banks 7*a* and 7*b* in such a manner as to be reciprocated. A crankshaft (not shown) is incorporated into the crankcase portion 2. As shown in FIG. 2, in the left and right banks 7*a* and 7*b*, connecting rods (not shown) of the pistons 8 are arranged in line along an axial line of the crankshaft. Therefore, the banks 7*a* and 7*b* are offset in a back and forth direction. In FIG. 2, the letter L designates an offset state between the left and right banks 7*a* and 7*b*.

As shown in FIGS. 4 and 5, a combustion chamber 11 is formed in the lower surface of each cylinder head 6 facing the cylinder 3. Each combustion chamber 11 includes, in the inside between the banks 7*a* and 7*b*, plural (for example, two) inlet ports 12*a* and 12*b* and plural (for example, two) inlet valves 13*a* and 13*b* for opening and closing the inlet ports 12*a* and 12*b*, respectively. Plural (for example, two) exhaust ports 14*a* and 14*b* and plural (for example, two) exhaust valves 15*a* and 15*b* for opening and closing the exhaust ports 14*a* and 14*b*, respectively, are provided in the outside between the banks 7*a* and 7*b*. Consequently, combustion air is drawn from the inside of the bank, and the burned gas is exhausted from the outside of the bank.

Single over head camshaft (SOHC) type variable valve systems 17 (corresponding to a variable valve mechanism of this application) constituting the variable valve device are provided in the cylinder heads 6 of the left and right banks 7*a* and 7*b*.

A variable valve system 17*a* of the left bank 7*a* includes a (three-mode switchable) inlet rocker arm module 18 and a (two-mode switchable) exhaust rocker arm module 19. The inlet rocker arm module 18 is switchable among a normal (low-speed) mode, a high-speed mode, and a cylinder suspension mode (mode for suspending the cylinder). The exhaust rocker arm module 19 is switchable between a normal (low-speed) mode and a cylinder suspension mode (mode for suspending the cylinder).

The variable valve system 17*a* of the left bank 7*a* is defined as a first variable valve mechanism in the present invention. The normal (low-speed) mode is defined as a first mode in the present invention. The high-speed mode is defined as a second mode in the present invention. The cylinder suspension mode is defined as a third mode in the present invention.

A variable valve system 17*b* of the right bank 7*b* includes a (two-mode switchable) inlet rocker arm module 20 and an exhaust variable valve device 21. The inlet rocker arm module 20 is switchable between a normal (low-speed) mode and a high-speed mode. The exhaust variable valve device 21 has only a normal (low-speed) mode. The variable valve system 17*b* of the right bank 7*b* is defined as a second variable valve mechanism in the present invention.

FIGS. 4 to 6 show a structure of the variable valve system 17*a* for one cylinder, which is mounted on the left bank 7*a* (when viewed from the rear side of the engine). FIG. 15 shows the rocker arm module 18 when viewed from the inside thereof. FIG. 16 shows the rocker arm module 18 exploded, and shows the rocker arm module 19 when viewed from the inside thereof. FIG. 18 shows the rocker arm module 19 exploded.

The structure of the one cylinder will be described below. Referring to FIGS. 2 and 4 to 6, reference numeral 25 is a camshaft which is rotatably arranged along a longitudinal direction of the cylinder head 6 in the center of an overhead location of the combustion chamber 11. Reference numeral 24 is a camshaft sprocket provided at an end (a shaft portion piercing through a front portion of the cylinder head 6) of the camshaft 25.

Reference numeral 26 is an inlet rocker shaft arranged on the inside of the camshaft 25 with respect to the bank substantially parallel to the camshaft 25. Reference numeral 27 is an exhaust rocker shaft arranged on the opposite side of the rocker shaft 26 (outside the bank) substantially parallel to the camshaft 25.

The pair of rocker shafts 26 and 27 is arranged above the camshaft 25. An oil passage 27*a* for the cylinder suspension mode is formed along an axial direction in the rocker shaft 27 of the pair of rocker shafts 26 and 27. An oil passage 26*a* for the cylinder suspension mode is formed in the rocker shaft 26. In the rocker shaft 26, an oil passage 26*b* for the high-speed mode is also formed along the axial direction parallel to the oil passage 26*a*.

As shown in FIG. 7, the rocker shafts 26 and 27 are arranged in the upper surfaces of ribs 6*a*. The cylinder 3 is located between the ribs 6*a* and the ribs 6*a* are raised from the upper surface portion of the cylinder head 6. As shown in FIG. 2, portions of the rocker shafts 26 and 27 are provided between the ribs 6*a* of the cylinder head 6 with plural rocker shaft caps 130.

Specifically, as shown in FIGS. 2 to 5, the rocker shaft cap 130 includes a rocker shaft cap 130*a* arranged between the cylinders 3 and a rocker shaft cap 130*b* arranged at the end of the bank.

As shown in FIGS. 4, 5, and 7, both the rocker shaft caps 130*a* and 130*b* have the structure in which plural cylindrical bolt insertion portions 133 allowing bolts 132 to be inserted therethrough are formed in a plate-shape base portion 131 spreading across the rocker shafts 26 and 27.

With the structure, as shown in FIGS. 5 and 7, in the rocker shaft caps 130*a* and 130*b*, the base portion 131 is fitted in recesses 134 formed in the upper portions (side opposite the rib 6*a*) of the rocker shafts 26 and 27, and bolts 132 are screwed in the ribs 6*a* from the bolt insertion portions 133 of the base portion 131 through holes 134*a* (shown in FIGS. 5 and 6) made in the rocker shafts 26 and 27. Consequently, the base portion 131 is fixed to the cylinder head 6 along with the rocker shafts 26 and 27.

Oil passages 140 are formed in the rocker shaft caps 130*a* and 130*b* as shown in FIG. 2. As shown in FIG. 7, each of the oil passages 140 is formed from a cylindrical portion 143 formed along the rocker shafts 26 and 27 on the base portion 131.

Specifically, the bottom side of the cylindrical portion 143 and the opening side closed by a plug 142 are extended to points of the rocker shafts 25 and 26, and a thin passage in an internal cavity of the cylindrical portion 143 is used as the oil passage 140. As shown in FIG. 7, through holes 143*a* and 143*b* communicated with the ends of the oil passage 140 are made in a backside portion of the base portion 131 which is of one end portion of the cylindrical portion 143 and a backside portion of the base portion 131 which is of the other end portion, respectively.

As shown in FIG. 7, the through hole 143*a* on the side of the exhaust-side rocker shaft 27 communicates with a branch hole 144*a* (also shown in FIG. 5) branching from the oil passage 27*a* of the rocker shaft 27. The through hole 143*b* on the side of the inlet-side rocker shaft 26 communicates with a branch hole 144*b* (also shown in FIG. 5) branching from the oil passage 26*a* of the rocker shaft 26.

The camshaft 25 is rotated by a crank output. In the camshaft 25, as shown in FIGS. 4, 5 and 8, a high-speed inlet cam 30, a non-lift cam 31, an exhaust cam 32, and a low-speed inlet cam 33 are formed in the order from the rear side in the region where the camshaft 25 is arranged in the overhead location of the combustion chamber 11.

The low-speed inlet cam 33 has a cam profile in which open-close timing and a valve lift amount are set so as to be suitable to low-speed running of the engine. The high-speed inlet cam 30 has a cam profile in which open-close timing and a valve lift amount (larger than that of the low-speed cam 33) are set so as to be suitable to high-speed running of the engine in the same base circle as the low-speed inlet cam 33. The non-lift cam 31 has a cam profile formed only by the base circle having the same radius larger than the base circles of the inlet cams 30 and 33 and the exhaust cam 32. The exhaust cam 32 has a cam profile in which open-close timing and a valve lift amount are set so as to be suitable to the discharge of the combustion gas.

The inlet rocker arm module 18 has a structure in which a hydraulic rocker arm is installed in the rocker shaft 26 as shown in FIGS. 4 to 6, 15 and 16. The rocker arm module 18 includes a valve drive rocker 35, and a pair of cam follower rockers 60 and 70 for the low-speed and high-speed modes. The valve drive rocker 35 drives the inlet valves 13*a* and 13*b*, and the cam follower rockers 60 and 70 follow the inlet cams 30 and 33, respectively.

As shown in FIGS. 4, 5 and 16, the valve drive rocker 35 includes a cylindrical rocker shaft supporting boss 36, a pair of (two) rocker arms 37, adjustment screws (abutment) 38, and mode switching operation portions 40*a* and 40*b*. The rocker arms 37 are extended from both end portions of the boss 36 toward the inlet valves 13*a* and 13*b* (radial direction of the boss). The adjustment screws 38 (abutment) are attached to the front-end portions of the rocker arms 37. The mode switching operation portions 40*a* and 40*b* are provided in base portions (proximal ends) of the rocker arms 37.

As shown in FIGS. 4 to 6, the rocker shaft 26 is rotatably fitted to the boss 36 of the rocker arm 37 in the range of a point where the inlet cam 30 (for high speed) exists to a point where the inlet cam 33 (for low speed) exists. The adjustment screws 38 in the front-end portions of the rocker arms 37 are positioned at the upper ends (valve stem ends) of the inlet valves 13*a* and 13*b* by the boss 36. That is, when the valve drive rocker 35 is rocked about the rocker shaft 26, the end portions of the adjustment screws 38 abut on the valve stem ends to drive the inlet valves 13*a* and 13*b*.

Figure 14:
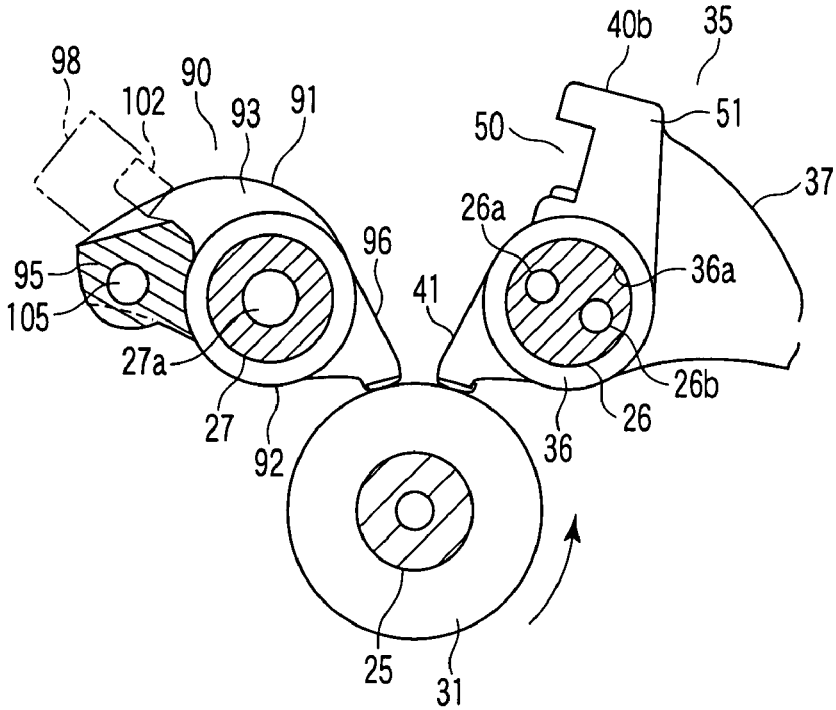
FIG. 14 is sectional view showing a non-lift cam when viewed from an arrow E of FIG. 6.

In the outer peripheral surface of the boss 36, a slipper 41 is projected toward the outer peripheral surface of the non-lift cam 31 from the region where the boss 36 faces the non-lift cam 31 as shown in FIGS. 14 to 16.

A projected length of the slipper 41 is set to a size which allows the front-end portion of the slipper 41 to abut on the outer peripheral surface of the non-lift cam 31 when the inlet valves 13*a* and 13*b* are closed. When the inlet valves 13*a* and 13*b* are closed, the slipper 41 is caused to abut on the non-lift cam 31 by reaction forces of valve springs of the inlet valves 13*a* and 13*b*, which prevents accidental motion of the whole of the valve drive rocker 35.

Figure 11:
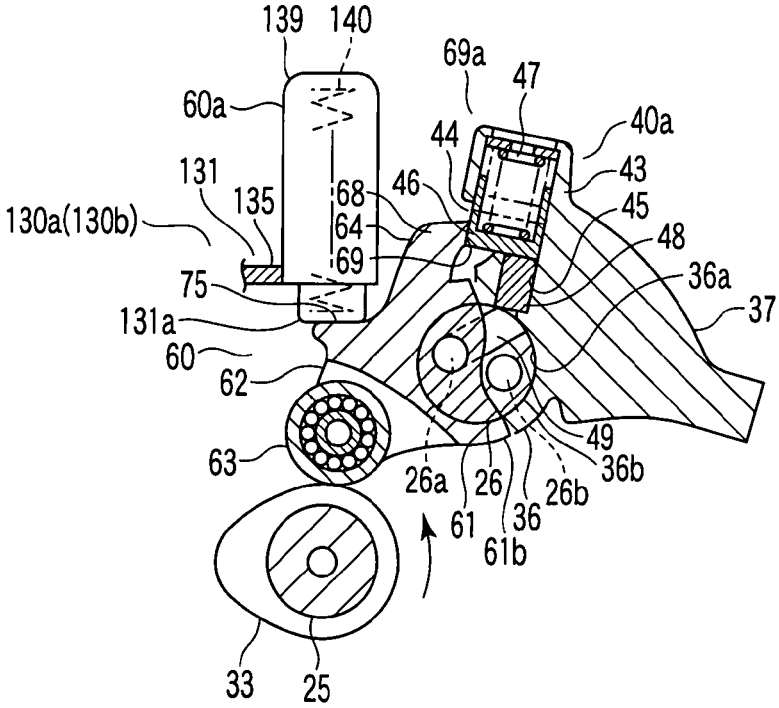
FIG. 11 is sectional view showing a rocker arm on an inlet side (low speed) when viewed from an arrow B of FIG. 6.

A piston type one is employed as both the switching operation portions 40*a* and 40*b* arranged in both end portions of the boss 36. The switching operation portion 40*a* arranged on the side of the inlet cam 33 (for low speed) will be described below. In FIGS. 11, 15 and 16, reference numeral 43 is a cylinder formed in the based portion of the rocker arm 37 on the side of the inlet cam 33, for example. The cylinder 43 is a longitudinal one extended along a radial direction of the rocker shaft 26. A window 44 is formed in a front surface (surface on the side of the camshaft 25) in the lower portion of the cylinder 43.

A through hole 45 (shown only in FIG. 11) having a diameter smaller than that of the cylinder 43 is made from a bottom of the cylinder 43 to an inner surface 36*a* (bearing surface) of the boss 36 located immediately below the cylinder 43. A piston 46 serving as a receiving portion is accommodated in the cylinder 43 along with a compression spring 47 which biases the piston 46 against the bottom of the cylinder 43 (shown only in FIG. 11).

With this constitution, usually the window 44 of the cylinder 43 is closed by the lower outer peripheral surface of the piston 46. When the piston 46 is raised, the piston 46 is retracted from the window 44 to open the window 44. As shown in FIG. 11, a pin 48 is slidably accommodated in the through hole 45. An opening located at a lower end of the through hole 45 communicates with a branch passage 49 branching from the oil passage 26*a*. Consequently, when an oil pressure is applied to the pin 48 through the oil passage 26*a*, the piston 46 blocking the window 44 is driven toward the direction in which the piston 46 is retracted from the window 44 by the raised motion of the pin 48 as shown by an alternate long and two dashes line of FIG. 11. That is, the window 44 is opened.

Figure 12:
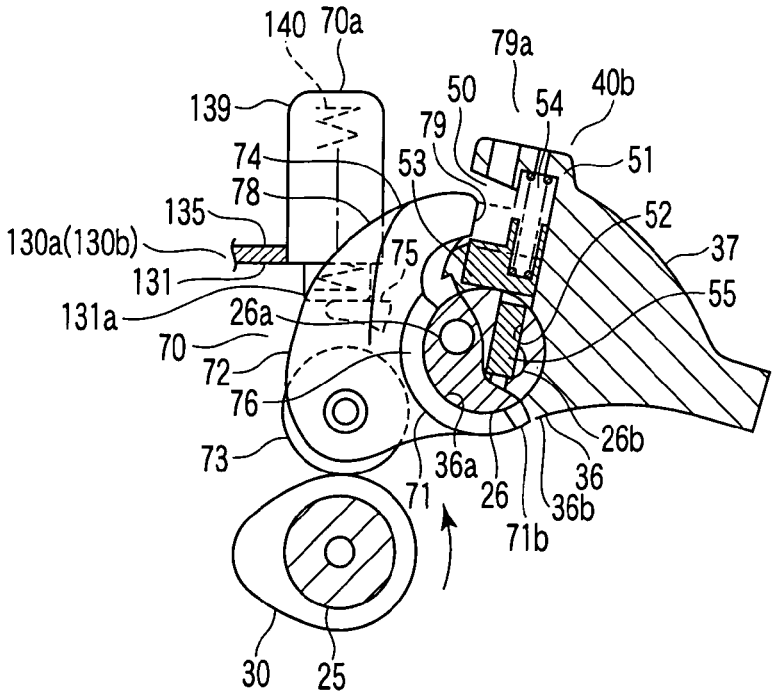
FIG. 12 is sectional view showing a rocker arm on an inlet side (high speed) when viewed from an arrow C of FIG. 6.

As with the switching operation portion 40*a*, a structure in which a cylinder 51 is formed in the base portion of the rocker arm 37 is employed in the switching operation portion 40*b* arranged on the side of the (inlet cam 30 (for high speed), as shown in FIGS. 12, 15 and 16. The cylinder 51 is extended to the inner surface 36*a* of the boss 36 to gain a stroke amount.

Therefore, a through hole 52 communicated with the cylinder 51 in series is made in the rocker shaft 26 located immediately below the cylinder 51. The through hole 52 has a diameter smaller than that of the cylinder 51. Unlike the switching operation portion 40*a*, as shown in FIG. 12, a window 50 is formed in the upper front surface of the cylinder 51, and a piston 53 is accommodated in the cylinder 51 along with a compression spring 54 which biases the piston 53 against the bottom of the cylinder 51.

A low-profile piston is used as the piston 53 such that the piston 53 can be accommodated in the cylinder portion on the lower side from the window 50. Contrary to the switching operation portion 40*a*, usually the opening of the window 50 of the cylinder 51 is opened, and the opening is closed by the outer peripheral surface of the piston 53 when the piston 53 is raised.

As shown in FIG. 12, a pin 55 is slidably accommodated in the through hole 52, and the lower-end portion of the through hole 52 communicates with a part of the oil passage 26*b* while intersecting the oil passage 26*b*. When the oil pressure is applied to the pin 55 through the oil passage 26*b*, therefore, the piston 53 is driven toward the direction in which the piston 53 blocks the window 50 by the raised motion of the pin 55 as shown by the alternate long and two dashes line of FIG. 12. That is, the window 50 is closed.

As shown in FIG. 16, notches 57 are formed in opening edges on both the end portions of the boss 36. The notch 57 is formed in such a manner that, in the peripheral wall forming the boss ends, the circumferential portion ranging from the portions immediately below the cylinders 43 and 51 to the base portion of the rocker arm 37 through the front portion of the boss 36 (on the side opposite the rocker arm 37) is continuously cut out.

As shown in FIGS. 4 to 6, 12, 15 and 16, the high-speed-side cam follower rocker 70 is arranged adjacent to the end portion on the side of the inlet cam 30 (for high speed) of the boss 36 (valve drive rocker). The cam follower rocker 70 includes a cylindrical rocker shaft supporting boss 71, a pair of roller support pieces (roller yoke) 72, a roller (rotating contact) 73, and an abutment 79. The rocker shaft 26 located adjacent to the end of the boss 36 is rotatably fitted to the boss 71. The roller support pieces 72 are linearly projected toward the overhead location of the inlet cam 30 (for high speed) from both end portions of the boss 71. The roller 73 is rotatably supported between the front-end portions of the roller support pieces 72. The abutment 79 is formed in a peripheral wall of the boss 71.

Therefore, the cam follower rocker 70 is constituted to have the roller 73 on one end side thereof and the abutment 79 on the other end side. The roller 73 is rotated while being in contact with the cam surface of the inlet cam 30. When the camshaft 25 is rotated, the cam follower rocker 70 is rotated about the boss 71, namely, the cam follower rocker 70 is rocked while following displacement of the inlet cam 30.

As shown in FIG. 16, a notch 76 is formed in the end portion of the boss 71 adjacent to the boss 36 (valve drive rocker). The notch 76 is formed by cutting out the peripheral wall portion on the side opposite the boss 36 (valve drive rocker).

For example, the circumferential portion ranging from the upper side of the boss 71 to the portion in front of the boss 71 (side opposite the roller 73) is continuously cut out. The notch 76 at the end of the boss 71 and the notch 57 at the end of the boss 36 are fitted to an edge portion 36*b* remaining at the opening end of the boss 36 and an edge portion 71*b* remaining at the opening end of the boss 71 in a complementary manner respectively.

The fitting of the above portions permits required motion of the cam follower rocker 70. By the fitting, the edge portion 36*b* at the end of the boss 36 and the edge portion 71*b* at the end of the boss 71 overlap around the axial direction of the rocker shaft 26 in the outer peripheral surface of the rocker shaft 26. The abutment 79 is arranged in the edge portion 71*b*, and the window 50, the cylinder 51, the piston 53, and the compression spring 54 are arranged in the edge portion 36*b*.

The abutment 79 and the piston 53 are positioned so as to face each other when the edge portion 36*b* and the edge portion 71*b* are overlapped. Therefore, as shown in FIGS. 15 and 16, the abutment 79 of the boss 71 and the window 50 located in the boss 36 face each other by utilizing the side-by-side arrangement of the rocker shafts 26 of the edge portions 71*b* and 36*b* in the circumferential direction.

The support piece of the roller support pieces 72 arranged close to the boss 36 (inside) is arranged substantially straight in front of the abutment 79. The roller support piece 72 on the other side and the abutment 79 are arranged in line with respect to the window 50.

As shown in FIGS. 15 and 16, the outer peripheral surface of the boss 71 has a wing portion 74 provided in the range from the abutment 79 to the inside roller support piece 72 (close to the boss 36). The wing portion 74 is formed by a rib 78 which continuously and linearly connects the abutment 79 and roller support piece 72.

The abutment 79 is formed in a shape which allows a horizontal wall of the front-end portion of the rib 78 to enter and leave from the window 50. With this shape, usually the abutment 79 enters and leaves from the cylinder 51 through the window 50. When the window 50 is blocked by the piston 53, the abutment 79 abuts on the piston 53 exposed from the window 50.

That is, the switching whether or not the displacement of the high-speed inlet cam 30 from the cam follower rocker 70 is transmitted to the valve drive rocker 35 is performed based on whether the abutment 79 strikes at the air or abuts on the piston 53. The abutment 79 and the piston 53 constitute a switching mechanism 79*a*.

A seat 75 is formed on the front-end side of the outside roller support piece 72 so as to receive a biasing force (force pressing the roller 73 against the inlet cam 30) from a pusher 70*a* assembled into the rocker shaft cap 130.

As shown in FIGS. 4 to 6, 11, 15 and 16, the lower-speed-side cam follower rocker 60 is arranged adjacent to the end portion on the side of the inlet cam 33 (for high speed) of the boss 36. The cam follower rocker 60 has a symmetric structure with the high-speed-side cam follower rocker 70. Because the cam follower rocker 60 has the same structure as the cam follower rocker 70, the same portions of the cam follower rocker 60 are designated by the numerals 61 to 69 in place of the numerals 71 to 79 designating the portions of the cam follower rocker 70, and the description is omitted.

Obviously, the abutment 69 is formed in a shape allowing the abutment 69 to enter and leave from the window 44. As for the cam follower rocker 60 also, usually the abutment 69 abuts on the piston 46 blocking the window 44 as shown in FIG. 11. When the window 44 is opened by the piston 46, the abutment 69 enters and leaves from the cylinder 43 through the window 44. That is, the switching whether or not the displacement of the low-speed inlet cam 33 from the cam follower rocker 60 is inputted to the valve drive rocker 35 is performed based on whether the abutment 69 strikes at the air or abuts on the piston 46. The abutment 69 and the piston 46 constitute the switching mechanism 69*a*.

As shown in FIGS. 4 to 6, 13, 17 and 18, a hydraulic rocker arm having a cam follower rocker 80 which follows the exhaust cam 32 and a valve drive rocker 90 which drives the exhaust valves 15*a* and 15*b* is employed for the exhaust rocker arm module 19.

The cam follower rocker 80 includes a cylindrical rocker shaft supporting boss 81, a U-shape roller support piece 82, a roller 83, and a wing portion 84. The rocker shaft 27 corresponding to the exhaust cam 32 is rotatably fitted in the boss 81. The roller support piece 82 is linearly projected from both the end portions of the boss 81 toward the overhead location of the exhaust cam 32. The roller 83 is rotatably supported between the front-end portions of the roller support piece 82. The wing portion 84 is formed in the boss 81.

The roller 83 is rotated while being in contact with the cam surface of the exhaust cam 32. When the camshaft 25 is rotated, the cam follower rocker 80 is rotated about the boss 81, namely, the cam follower rocker 80 is rocked while following the displacement of the exhaust cam 32. A seat 85 is formed on the front-end side of the cam follower rocker 80 so as to receive a biasing force (force pressing the roller 83 against the exhaust cam 32) from a pusher 80*a* assembled into a rocker shaft cap 130.

The wing portion 84 is formed by a rib 86 projected toward the center in the width direction of the outer surface of the boss 81. The rib 86 is extended along a circumferential direction of the boss 81 from the rear-end portion of the roller support piece 82 to the upper portion of the boss 81. An abutment 89 formed in a shape protruding forward is provided in the front-end portion of the rib 86.

As shown in FIGS. 4 to 6, 13, 17 and 18, the valve drive rocker 90 includes rocker arms 91 arranged on both sides of the boss 81 (cam follower rocker 80) and a mode switching operation portion 98.

A pair of cylindrical rocker shaft supporting bosses 92 is provided in one end portion of the rocker arm 91. The rocker shaft 27 is rotatably fitted in the bosses 92 on both sides where the boss 81 (cam follower rocker 80) is located between the bosses 92. Arms 93 are provided in the other end portion of the rocker arms 91, the arms 93 being linearly extended from the bosses 92 to the exhaust valves 15*a* and 15*b*, respectively.

Adjustment screws 94 are provided in the front-end portions of the arms 93. The adjustment screws 94 are arranged at the upper ends (valve stem ends) of the exhaust valves 15*a* and 15*b*, respectively.

The front-end portions of the arms 93 and 93 are connected by, for example, a plate-shape connecting arm 95. Therefore, the valve drive rocker 90 has a gate shape. When the valve drive rocker 90 is rocked about the rocker shaft 27, the plural exhaust valves 15*a* and 15*b* are driven.

As shown in FIGS. 14, 17 and 18, a slipper 96 is provided so as to be projected toward the outer peripheral surface of the non-lift cam 31 from the outer peripheral surface of the boss 92 arrange in the overhead location of the non-lift cam 31.

A projected length of the slipper 96 is set to a size which allows the front-end portion of the slipper 96 to abut on the outer peripheral surface of the non-lift cam 31 when the exhaust valves 15*a* and 15*b* are closed. When the exhaust valves 15*a* and 15*b* are closed, the slipper 96 is caused to abut on the non-lift cam 31 by reaction forces of the valve springs of the exhaust valves 15*a* and 15*b*, which prevents the accidental motion of the whole of the rocker arm 91.

Figure 13:
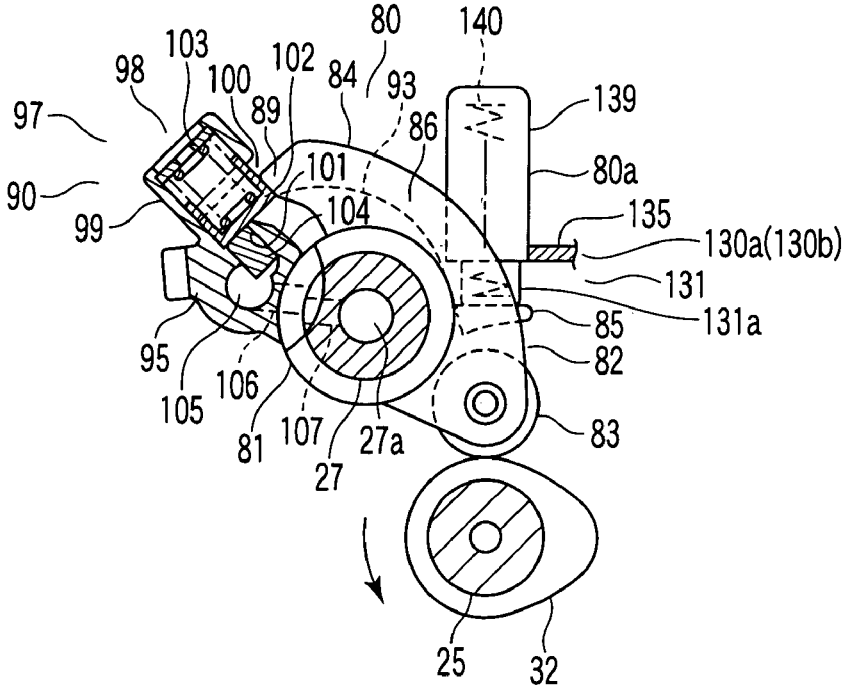
FIG. 13 is sectional view showing a rocker arm on an exhaust side when viewed from an arrow D of FIG. 6.

As shown in FIGS. 13, 17 and 18, the switching operation portion 98 is provided in the connecting arm 95. A piston type one is used as the switching operation portion 98 as shown in FIG. 13.

The switching operation portion 98 will be described below. In FIG. 13, reference numeral 99 is a vertical cylinder. The cylinder 99 is formed so as to be projected upward from the center of the connecting arm 95. The cylinder 99 is inclined toward the direction in which the cylinder 99 is separated from the rocker shaft 27. A window 100 is formed in the front surface (surface on the side of the camshaft 25) in the lower portion of the cylinder 99. A through hole 101 having a diameter smaller than that of the cylinder 99 is made from the bottom of the cylinder 99 to the inside of the arm located immediately below the cylinder 99.

A piston 102 serving as a receiving portion is accommodated in the cylinder 99 along with a compression spring 103 which biases the piston 102 against the bottom of the cylinder 99. That is, usually the window 100 of the cylinder 99 is closed by the outer peripheral surface of the piston 102, and the piston 102 is retracted from the window 100 to open the window 100 when the piston 102 is raised.

A pin 104 is slidably accommodated in the through hole 101. As shown in FIGS. 6 and 13, an opening located at the lower end of the through hole 101 communicates with a relay passage 105 formed in the connecting arm 95. The relay passage 105 is opened to the inner surface of the boss 92 through a relay passage 106 formed in the arm 93.

The relay passage 106 communicates with a branch passage 107 (only shown in FIG. 13) branching from the oil passage 27*a*. When the oil pressure is applied to the pin 104 through the oil passage 27*a*, the piston 102 blocking the window 100 is driven toward the direction in which the piston 102 is retracted from the window 100 by the raised motion of the pin 104 as shown by the alternate long and two dashes line of FIG. 13. That is, the window 100 is opened.

The abutment 89 of the cam follower rocker 80 is positioned in front of the window 100. As shown in FIGS. 17 and 18, the abutment 89 is formed in a shape allowing the abutment 89 to enter and leave from the window 100. With this constitution, usually the abutment 89 abuts on the piston 102 blocking the window 100. When the window 100 is opened, the abutment 89 enters and leaves from the cylinder 99 through the window 100. In other words, the switching whether or not the displacement of the exhaust cam 32 from the cam follower rocker 80 is transferred to the valve drive rocker 90 is performed based on whether the abutment 89 strikes at the air or abuts on the piston 102. The abutment 89 and the piston 102 constitute a switching mechanism 97. This structure is also adopted in each cylinder 3 of the left bank 7*a*.

Each of the rocker arm modules 20 of the variable valve system 17*b* in the right bank 7*b* has a structure in which the mechanisms and parts which do not drive the valves are removed from the inlet rocker arm module 18 in the left bank 7*a*. Although not shown in detail, in the structure, the low-speed-side switching structure (mainly the switching operation portion 40*a* and cam follower rocker 60) is omitted, and the valve drive rocker 35 is always directly driven by the low-speed inlet cam 33. Therefore, the two-stage switching can be performed between the low-speed mode (normal) and the high-speed mode while only the high-speed-side switching structure is left.

The exhaust side has a structure in which the mechanisms and parts which do not drive the valves are removed from the exhaust rocker arm module 19 in the left bank 7*a*, i.e., the structure in which only the valve drive rocker 90 is always directly driven by the exhaust cam.

The right bank 7*b* also has a structure in which the oil passages 26*a* and 27*a* for cylinder suspension mode are omitted while only the oil passage 26*b* is left. In other words, in the structure of the right bank 7*b*, two-stage switching of the valve drive with the high-speed inlet cam and the valve drive with the low-speed inlet cam can be performed in the inlet system, and only the valve drive (normal mode) with the exhaust cam can be performed in the exhaust system.

On the other hand, as shown in FIGS. 1 to 3, an oil control valve 120 (hereinafter referred to as OCV 120) for cylinder suspension mode, which is a mode switching oil control valve, is provided at the front end of the left bank 7*a* which is of the front side (corresponding to the automobile body end side) when the engine is installed in the engine compartment. The OCV 120 is defined as a second oil control valve in the present invention.

An oil control valve 121 (hereinafter referred to as OCV 121) for high-speed mode is provided at the rear end of the right bank 7*a* which is of the rear side. The bank ends to which the OCVs 120 and 121 are attached are regions facing a front-side offset space L1 and a rear-side bank offset space L2 which are generated by the offset between the left and right banks 7*a* and 7*b*, so that the OCVs 120 and 121 are accommodated in the bank offset spaces L1 and L2. The OCV 121 is defined as a first oil control valve in the present invention.

Of the OCVs 120 and 121, the OCV 120 for cylinder suspension mode which is attached to the left bank 7*a* includes, as shown in, for example, FIGS. 3, 9 and 10, a base portion 160, a thrust support portion 161, and a control valve 162. The base portion 160 is attached to the end face of the left bank 7*a*. The thrust support portion 161 supports, from a thrust direction, a camshaft end formed in the base portion 160 and projected from the bank end. The control valve 162 is assembled into the base portion 160.

An electromagnetic spool valve is used as the control valve 162. The spool valve is configured such that, for example, a housing 163 (shown in FIGS. 3 and 10) is integrally formed above the base portion 160 and a spool 164 (shown in FIG. 10) is accommodated in the housing 163. That is, the control valve 162 has a structure in which the open-close operation is performed by the displacement of the spool 164.

However, the portion projected upward from the housing 163 is a solenoid 164*a* which drives the spool 164. Each portion of the base portion 160 is fixed to each portion at the front end of the left bank 7*a* with a fixing member such as a bolt 165, which attaches the whole of the OCV 120 to the outer wall surface of the left bank 7*a* which is the cylinder suspension bank.

As shown in detail in FIGS. 9 and 10, an oil pump 170 for cylinder suspension mode, which is a mode switching oil pump, is integrally provided in the OCV 120. A camshaft-driven pump e.g., a plunger pump is used as the oil pump 170.

The plunger pump includes, for example, pump driving cams 171 (in this case, three cams are arranged at equal intervals) and a plunger 172. The cams 171 are formed in the outer peripheral surface in the end portion of the camshaft 25 projected from the bank end. The plunger 172 is provided in the housing 163 (defining the outline of the OCV 120).

Specifically, in the plunger 172, a cylinder portion 173 is provided in the range of the housing portion (area where the pump driving cam 25 is located) located around the camshaft to the upper portion of the housing. A plunger 174, a spring member 200, and an accumulator 172*a* are incorporated into the cylinder portion 173. The spring member 200 presses the plunger 174 against the pump driving cam 171. One-way valves 175 are attached to a discharge passage 174*a* and a suction passage 174*b* of the plunger 174 to constitute a discharge portion and a suction portion, respectively.

With this constitution, the oil pump 170 is arranged at the point closest to the control valve 162, and the oil pressure can be introduced to the control valve 162 with least loss. Obviously, in the oil pump 170, the pumping operation is performed in each time the plunger 174 hurdles the pumping driving cam 171 of the camshaft 25. With the installation structure of the oil pump 170, the oil pump 170 and OCV 120 are provided in the front end of the left bank 7*a*.

Consequently, the control valve 162 which is the main part of the OCV 120 is exposed to the outside of the engine body 1. Furthermore, the control valve 162 is exposed along with the oil pump 170 at the end of the engine compartment R, i.e., in the front portion, where the control valve 162 is located at a conspicuous and near-at-hand position when the engine compartment R is opened.

The suction portion (suction passage 174*b*) of the plunger pump communicates with an oil reservoir such as an oil pan (not shown) in the engine body. The discharge portion (discharge passage 174*a*) communicates with an entrance 162*a* of the spool valve (control valve 162). Even in the low engine revolution speed, the high oil pressure necessary to switch to the cylinder suspension mode is secured by the pump operation performed by the camshaft drive (driven double the crank output).

The control valve 162 and the oil pump 170 are radially (with respect to the camshaft 25) projected toward the upward of the cylinder head 6 to facilitate the maintenance.

Like the left bank 7*a*, for example, the OCV 121 includes a base portion 180, a thrust support portion (not shown), and a control valve 182, e.g., an electromagnetic spool valve. The base portion 180 is attached to the end surface of the right bank 7*b*. The thrust support portion supports, from a thrust direction, a camshaft end formed in the base portion 180 while projected from the bank end. The control valve 182 is incorporated into the thrust support portion and the base portion 180.

As with the OCV 120, the OCV 121 is fixed with the bolt. In addition to the control valve 182, the OCV 121 includes an accumulator 183 which accumulates oil pressure from a lubricating oil pump (not shown) for pumping up engine oil from the oil pan, and a passage (not shown) through which the oil accumulated in the accumulator 183 is introduced to an entrance (not shown) of the control valve 182.

The oil pressure necessary to switch to the high-sped mode is secured by the oil of the accumulator 183 or the oil from the lubricating oil pump which is driven according to the engine revolution speed (the switching to the high-speed mode is performed in the high engine revolution speed range).

As shown in FIGS. 2 and 7, an exit (not shown) of the control valve 162 of the OCV 120 communicates with the oil passage 27*a* of the rocker shaft 27 (exhaust side) through a passage 153 formed in the cylinder head 6 (left bank 7*a*) such that the oil pressure is introduced to the variable valve system 17*a* with the shortest path. The oil passage 26*a* of the rocker shaft 26 communicates with a return passage 153*a* (shown only in FIG. 7) formed in the cylinder head 6.

As shown in FIG. 2, an exit of the control valve 182 of the OCV 121 communicates with the oil passage 26*b* (right bank 7*b*) of the inlet-side rocker shaft 26 through the passage 6*b* formed in the cylinder head 6 of the right bank 7*b*. The passage 6*b* is defined as oil passage in the present invention. As shown in FIG. 2, the discharge portion of the control valve 182 of the OCV 121 communicates with the oil passage 26*b* of the rocker shaft 26 (inlet side) of the left bank 7*a* through a relaying pipe member 155 connecting the left and right banks 7*a* and 7*b*, an entrance 156*a* provided at the end of the cylinder head 6 (left bank 7*a*), and a passage 156 communicated with the entrance 156*a*.

With the constitution, when the control valve 182 (OCV 121) is operated, the oil pressure is applied to the variable valve systems 17*a* and 17*b* of the left and right banks 7*a* and 7*b* from the accumulator 183, which allows the running of the banks 7*a* and 7*b* to switch from the normal mode to the high-speed mode. When the control valve 162 (OCV 120) is operated, the oil pressure is applied from the camshaft-driven oil pump 170 to the variable valve system 17*a*, which allows the running of the left bank 7*a* to switch to the cylinder suspension mode in which the left bank 7*a* is stopped.

The control valves 162 and 182 of the OCVs 120 and 121 are connected to the control unit 122 (formed by, for example, a microcomputer). The control unit 122 has a function according to a map previously set dependent on the running state of the automobile, for example. In the function, the control valves 162 and 182 of the OCVs 120 and 121 are closed up to a predetermined engine revolution range (normal drive state) in which the engine runs normally, only the control valve 182 of the OCV 121 is opened from the high engine revolution range exceeding the predetermined revolution speed range, and only the control valve 162 of the OCV 120 is opened in the cylinder suspension range where the stable running conditions are satisfied with no large output.

With this constitution, the inlet-side switching mechanisms 69*a* and 79*a* and the exhaust-side switching mechanism 97 are switchable between the running modes by the variable valve device according to the running state of the automobile (vehicle).

In this embodiment, the engine body 1, the variable valve system 17*a*, variable valve system 17*b*, the OCV 120, and the OCV 121 compose a variable valve device 300 which is defined as a variable valve device in the present invention.

Action of the variable valve system 17 will be described with reference to FIGS. 11 to 14. The control unit 122 keeps the control valves 162 and 182 of the OCVs 120 and 121 closed when a command for performing the low-speed mode is provided to the control unit 122 according to the running state of the automobile.

That is, the oil pressure does not act in the oil passages 26*a*, 26*b* and 27*a*. As shown by the solid line of FIG. 11, the window 44 of the switching operation portion 40*a* (inlet) of the left bank 7*a* is blocked by the piston 46 (by the elastic force of the compression spring 47). The window 50 of the switching operation portion 40*b* (inlet) is opened (by the elastic force of the compression spring 54) as shown by a solid line of FIG. 12.

As shown in FIG. 13, the window 100 of the switching operation portion 98 (exhaust) of the left bank 7*a* is blocked by the piston 102 (by the elastic force of the compression spring 103). Then, in the left bank 7*a*, the inlet-side cam follower rocker 60 (low speed) and the exhaust-side cam follower rocker 80 are rocked while abutting on the pistons 46 and 102.

Accordingly, in the left bank 7*a*, the displacement of the inlet cam 33 (for low speed) is transmitted from the valve drive rocker 35 to the stem ends of the inlet valves 13*a* and 13*b* through the rocker arms 37, thereby driving the inlet valves 13*a* and 13*b*. The displacement of the exhaust cam 32 is also transmitted from the connecting arm 95 of the valve drive rocker 90 to the stem ends of the exhaust valves 15*a* and 15*b* through the arms 93, thereby driving the exhaust valves 15*a* and 15*b*.

On the inlet side of the right bank 7*b*, as with the left bank 7*a*, only the displacement of the low-speed inlet cam (not shown) transmitted to the valve drive rocker 35 is transmitted to the inlet valve (not shown), which drives the inlet valve. On the exhaust side, the displacement of the exhaust cam (not shown) is directly transmitted to the exhaust valve through the valve drive rocker 90, which drives the exhaust valve.

Therefore, the left and right banks 7*a* and 7*b* are operated in the low-speed mode brought by the combination of the low-speed cam and the exhaust cam of FIG. 19 (up to a predetermined engine revolution speed range: normal running).

The control unit 122 opens only the control valve 182 of the OCV 121 for high-speed mode when the engine becomes a high revolution speed range exceeding the predetermined revolution range due to the running such as acceleration in which the high output is required. This enables the high oil pressure accumulated in the accumulator 183 or the high oil pressure from the lubricating oil pump driven at high revolution speed by the crank output to be introduced to the oil passage 26*b* of the left bank 7*a* and the oil passage 26*b* (inlet-side rocker shaft) of the right bank 7*b* through the pipe member 155 and the passage 156.

Accordingly, the oil pressure necessary for the switching is applied to the pin 55 of the (inlet-side) switching operation portion 40*b* of the left bank 7*a* or right bank 7*b*. Thus, the piston 53 driven upward by the pin 55 blocks the window 50 as shown by the alternate long and two dashes line of FIG. 12. Then, as shown by the alternate long and two dashes line of FIG. 12, the inlet-side cam follower rockers 70 of the left and right banks 7*a* and 7*b* are rocked while abutting on the piston 53.

Because an outer shape of the high-speed inlet cam 30 is set larger than that of the low-speed inlet cam 33, only the displacement of the inlet cam 30 (for high speed) transmitted from the cam follower rocker 70 is transmitted from the valve drive rocker 35 to the inlet valves 13*a* and 13*b*. That is, the inlet valves 13*a* and 13*b* of the left and right banks 7*a* and 7*b* are driven only by the high-speed inlet cam 30.

The displacement of the exhaust cam 32 is transmitted from the cam follower rocker 80 to the connecting arm 95 of the valve drive rocker 90, which continuously drives the exhaust valves 15*a* and 15*b* of the left bank 7*a*. The exhaust valve of the right bank 7*b* is kept running in the same motion. Therefore, the left and right banks 7*a* and 7*b* switch to the high-speed mode brought by the combination of the high-speed cam and the exhaust cam of FIG. 19.

When the automobile enters the running state in which the fuel consumption is reduced, e.g., low-speed and medium-speed running or idling, the control unit 122 performs the cylinder suspension mode (mode for reducing fuel consumption). That is, the control unit 122 performs the control to open the control valve 162 of the OCV 120 for cylinder suspension mode.

At this point, because the oil pump 170 for cylinder suspension mode which is attached to the OCV 120 is driven by the rotation (double the crankshaft) of the camshaft 25, the oil pressure enough to drive switching of the variable valve system 17*a* is secured even in the low engine revolution speed state (even idling), in other words, even if the oil pressure is not secure in the accumulator 172*a*.

As shown in FIG. 2, the oil pressure of the oil pump 170 is supplied to the passage 153 through an open-close port of the control valve 162, which introduces the oil pressure to the oil passage 27*a* of the rocker shaft 27 (exhaust side). Then, the oil pressure of the oil passage 27*a* is introduced to the oil passage 26*a* of the rocker shaft 26 (inlet side) in the left bank 7*a*, which raises the piston 46 of each switching operation portion 40*a*.

Accordingly, the window 44 of the inlet-side switching operation portion 40*a* is opened. Because the oil pressure does not act on the switching operation portion 40*b*, the window 50 is opened (see FIG. 12).

Consequently, in the left bank 7*a*, the cam follower rockers 60 (inlet: low speed) and the cam follower rockers 80 (exhaust) are rocked while striking the air. This interrupts the transmission of the driving force for driving the valve to the valve drive rockers 35 and 90 (inlet and exhaust).

At this point, in the inlet variable valve devices 20 and the exhaust variable valve device 21 of the right bank 7*b*, the displacement of the inlet cam is continuously transmitted to the inlet valve while the displacement of the exhaust cam is continuously transmitted to the exhaust valve. For this reason, the engine switches to the cylinder suspension mode in which the left bank 7*a* is suspended.

Since in the running of the cylinder suspension mode, the range of the cylinder suspension mode is widened by the camshaft-driven oil pump 170, a frequency of the cylinder suspension mode is increased. Therefore, the opportunity to perform maintenance of the OCV 120 including the oil pump 170 is increased.

The maintenance will be described below. It is assumed that the maintenance of the OCV 120 and the oil pump 170 is performed. Both the OCV 120 and the oil pump 170 are attached to the outer surface of the engine body 1.

For this reason, the whole of the OCV 120 including the oil pump 170 emerges in the engine compartment R when the engine compartment R is once opened. It suffices that the maintenance be performed to the emerged OCV 120 and oil pump 170 outside the engine body.

Accordingly, the maintenance can be performed to the control valve 162 and oil pump 170 without doing the troublesome work for detaching the parts of the engine body 1.

Additionally, the OCV 120 and the oil pump 170 are attached to the cylinder head end (engine body portion arranged in the upper portion of the engine compartment R) which is a conspicuous and near-at-hand position, so that the maintenance is easily performed in the OCV 120 and the oil pump 170.

Particularly, the oil pump 170 is provided in the housing 163 of the OCV 120, which brings the oil pump 170 closest to the control valve 162 (switching portion). Therefore, the oil pressure can effectively be given to the variable valve system 17*a* while the loss is suppressed. Moreover, the oil pump 170 constitutes a part of the OCV 120, and thus, simplification of the oil pump 170 is achieved.

In the V-type engine, the OCV 120 and the oil pump 170 are arranged at the near-at-hand position when the OCV 120 and the oil pump 170 are provided in the outer wall surface at the cylinder head end of the bank 7*a*, where the cylinder suspension mode is performed, by utilizing the feature of the V-type engine. This enables the easy maintenance of the OCV 120 and the oil pump 170.

Particularly, when the left bank 7*a* to which the OCV 120 is attached is transversely installed in the engine compartment, the left bank 7*a* is arranged on the automobile body end side (front side in the embodiment). Consequently, the OCV 120 and the oil pump 170 are initially recognized conspicuous during the maintenance. The OCV 120 and the oil pump 170 are also arranged at the most near-at-hand position. This gives the high maintenance property for the OCV 120 and the oil pump 170.

Similarly, the ease of maintenance is improved when the OCV 120 and the oil pump 170 are arranged on the automobile body end side also in the longitudinally-mounted engine. The ease of maintenance is further improved when the OCV 120 and the oil pump 170 are arranged on the automobile body front side.

The switching to the high-speed mode is performed only by the OCV 121 which is commonly used in the left and right banks 7*a* and 7*b*, so that the switching between the high-speed mode and the cylinder suspension mode can be performed only by the least number of OCVs, i.e., the OCVs 120 and 121 respectively arranged in the banks 7*a* and 7*b*.

Accordingly, the number of expensive OCVs can be decreased, so that the engine cost and the engine weight can be reduced.

The OCVs 120 and 121 can be assembled to the engine compactly because OCVs 120 and 121 are arranged in the bank offset spaces L1 and L2 which become the dead space in the V-type engine. Therefore, the upsizing of the engine is suppressed.

Additionally, the OCV 120 for cylinder suspension mode is arranged not in the bank but in the outer surface of the bank end, so that the maintenance is easily performed to the OCV 120 (because of the unnecessary work for detaching various parts to expose the OCV 120 to the outside of the bank).

Particularly, compared with the OCV 121, the OCV 120 for cylinder suspension mode is arranged on the automobile body end side (the automobile body front side in the embodiment) irrespective of the attitude in which the engine is installed in the engine compartment (transversely or longitudinally mounted engine). Therefore, in the maintenance, the OCV 120 for cylinder suspension mode, having a higher maintenance frequency than that of the OCV 121, is located at the conspicuous and near-at-hand position, and the maintenance property is high. According to the embodiment, arrangement of the OCV 120 for cylinder suspension mode on the automobile body front side further improves the ease of maintenance.

The invention is not limited to the embodiment, and various changes and modifications could be made without departing from the scope of the invention.

Although the variable valve mechanism which switches to the cylinder suspension mode using the piston structure in the embodiment, for example, another variable valve mechanism which switches to the cylinder suspension mode may be used.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A variable valve device for an internal combustion engine, comprising:

an internal combustion engine body having a plurality of cylinders;

a variable valve mechanism which is provided in the body and is switchable between at least two modes with oil pressure;

a mode switching oil control valve which switches the variable valve mechanism to each mode; and a camshaft-driven mode switching oil pump which supplies an oil pressure for switching driving to the variable valve mechanism according to the switching of the mode switching oil control valve, the mode switching oil pump being, along with the mode switching oil control valve, provided above the camshaft in an outer wall surface of the body.

2. The variable valve device for an internal combustion engine, according to claim 1, wherein the internal combustion engine body has a cylinder head in which the variable valve mechanism is installed, the mode switching oil control valve is provided in an outer wall surface of an end portion of the cylinder head, and the mode switching oil pump is provided in a housing defining an outline of the mode switching oil control valve.

3. The variable valve device for an internal combustion engine, according to claim 1, wherein the internal combustion engine body is a V-type engine body in which a cylinder bank is separated into a first bank and a second bank, the variable valve mechanism is switchable to a cylinder suspension mode with the oil pressure, the cylinder being suspended in one of the banks of the body in the cylinder suspension mode, the mode switching oil control valve is provided in an outer wall surface of an end portion of a cylinder head constituting the suspended bank, and the mode switching oil pump is provided in a housing defining an outline of the mode switching oil control valve.

4. The variable valve device for an internal combustion engine, according to claim 3, wherein the mode switching oil control valve and the mode switching oil pump are arranged on a vehicle body end side when the internal combustion engine is installed in an engine compartment of a vehicle.

5. The variable valve device for an internal combustion engine, according to claim 1, wherein the internal combustion engine body is a V-type engine body in which a cylinder bank is separated into a first bank and a second bank, the variable valve mechanism includes: a first variable valve mechanism which is provided in the first bank and configured to switch running of the bank to a first mode, a second mode, and a third mode with oil pressure; and a second variable valve mechanism which is provided in the second bank and configured to switch running of the bank to a first mode and a second mode with oil pressure, the mode switching oil control valve includes: a first oil control valve which controls the oil pressure to the first variable valve mechanism and the second variable valve mechanism in order to switch the running of the first and second banks to the first mode and the second mode;

and a second oil control valve which controls the oil pressure to the first variable valve mechanism in order to switch the first bank to the third mode, and the first oil control valve is provided only in one of the first bank and the second bank, the oil pressure is applied to the variable valve mechanism on one bank side through an oil passage formed in the one bank, and the oil pressure is applied to the variable valve mechanism on the other bank side through a pipe member connecting the first and second banks.

6. The variable valve device for an internal combustion engine, according to claim 5, wherein the first oil control valve is attached to an end of the second bank which faces a bank offset space brought by a layout between the first bank and the second bank, and the second oil control valve is attached to an end of the first bank which faces a bank offset space on the opposite side.

7. The variable valve device for an internal combustion engine, according to claim 6, wherein the third mode is a suspension mode in which operation of the first variable valve mechanism is suspended, and the second oil control valve is arranged on the vehicle body end side closer than the first oil control valve when the internal combustion engine is installed in an engine compartment of a vehicle.

8. The variable valve device for an internal combustion engine, according to claim 1, wherein the camshaft-driven mode switching oil pump includes a plunger accommodated inside a plunger housing, and the plunger is driven by a pump driving cam formed on the camshaft.

9. A variable valve device for an internal combustion engine, comprising:

a camshaft that operates at least one of an exhaust valve and an intake valve, the camshaft having at least one pump driving cam formed on a periphery thereof;

a variable valve mechanism provided in the internal combustion engine and switching between at least two operating modes by an oil pressure;

a mode switching oil control valve which selectively switches the variable valve mechanism among the operating modes; and an oil pump provided with a plunger accommodated in a plunger housing and driven by the at least one pump driving cam and supplying the oil pressure to the variable valve mechanism in accordance with a mode of the mode switching oil control valve, wherein a center axis of the oil pump extends in a direction substantially perpendicular to a center axis of a camshaft and a center axis of the mode-switching oil control valve extends in a direction substantially perpendicular to the center axis of the camshaft and at an angle with respect to the center axis of the oil pump.

* * * * *